US005397092A

United States Patent [19]

Black

[11] Patent Number: 5,397,092

[45] Date of Patent: Mar. 14, 1995

[54] ARTWORK MOUNTING PEG

[76] Inventor: Barbara A. Black, 755 Bayer Dr., Palatine, Ill. 60067

[21] Appl. No.: 91,777

[22] Filed: Jul. 14, 1993

[51] Int. Cl.[6] ..... A47G 1/16; G09F 1/12; F16B 23/00

[52] U.S. Cl. ..... 248/490; 411/400; 411/546; 40/156

[58] Field of Search ..... 411/377, 431, 389, 397, 411/546, 923, 400, 401, 424; 248/488, 490; 40/152.1, 156

[56] References Cited

U.S. PATENT DOCUMENTS

| | | | |
|---|---|---|---|
| 383,951 | 6/1888 | Hegbom . | |
| 446,871 | 2/1891 | Lieb | 411/389 |
| 721,579 | 2/1903 | Barr . | |
| 735,618 | 10/1903 | Tannewitz | 411/424 |
| 975,310 | 11/1910 | de Ybarrondo | 411/923 X |
| 1,583,544 | 5/1926 | Frisbey | 411/923 X |
| 2,093,261 | 9/1937 | Willson | 72/19 |
| 2,114,451 | 4/1938 | Mattes | 72/23 |
| 2,124,440 | 7/1938 | Tallberg | 40/140 |
| 2,246,457 | 6/1941 | Schultz . | |
| 2,686,641 | 8/1954 | Friedrich | 248/30 |
| 2,802,297 | 8/1957 | Taylor | 45/138 |
| 3,083,796 | 4/1963 | Bell, Jr. | 411/546 X |
| 3,347,504 | 10/1967 | Goss | 248/488 |
| 3,418,869 | 12/1968 | Hepich | 411/546 X |
| 4,394,000 | 7/1983 | Kurtz | 248/466 |
| 4,446,642 | 5/1984 | Chap | 40/152 |
| 4,497,125 | 2/1985 | Hutchinson | 40/10 |
| 4,599,842 | 7/1986 | Counihan | 52/586 |
| 4,863,136 | 9/1989 | Sanders | 248/490 |
| 5,098,239 | 3/1992 | Thiel | 411/377 |
| 5,199,681 | 4/1993 | Reidy | 248/488 |

FOREIGN PATENT DOCUMENTS

| | | | |
|---|---|---|---|
| 869300 | 1/1942 | France . | |
| 453048 | 11/1927 | Germany | 411/397 |
| 582178 | 9/1958 | Italy . | |
| 642130 | 7/1962 | Italy | 411/397 |
| 920221 | 3/1963 | United Kingdom | 411/377 |

*Primary Examiner*—Neill R. Wilson

*Attorney, Agent, or Firm*—Marshall, O'Toole, Gerstein, Murray & Borun

[57] ABSTRACT

An artwork mounting peg has a spacer connected to a cap by a neck so that a groove is defined between the cap and the spacer. Means are provided for attaching the peg to a wall or other object onto which artwork is to be mounted. When the artwork mounting peg is attached to a wall, the artwork is placed in the groove to secure the artwork a short distance off the wall.

9 Claims, 2 Drawing Sheets

FIG. 6
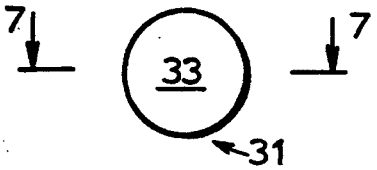
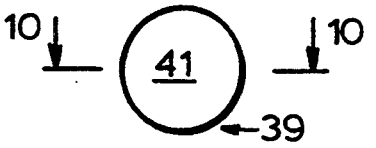
FIG. 9
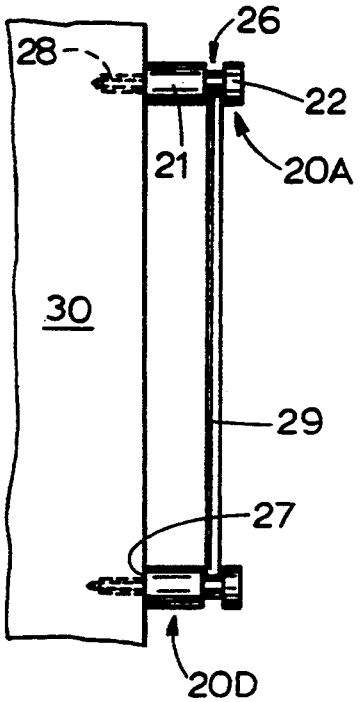
FIG. 5
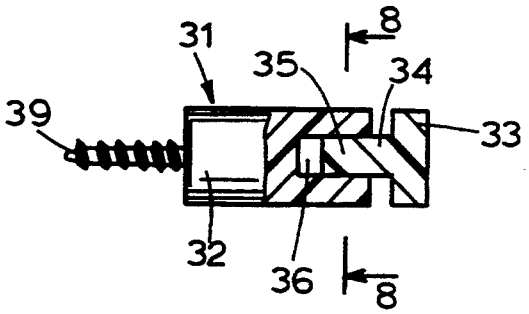
FIG. 7
FIG. 8
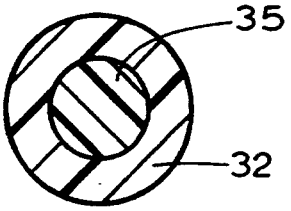
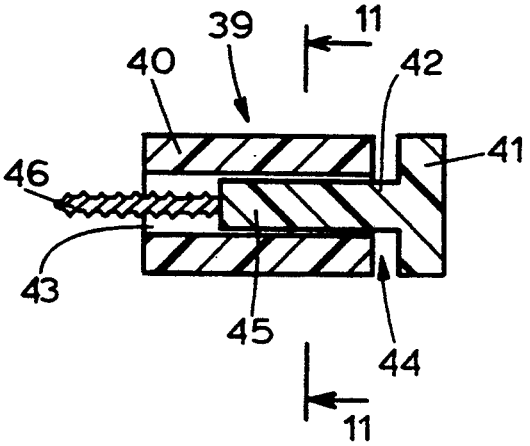
FIG. 10
FIG. 11
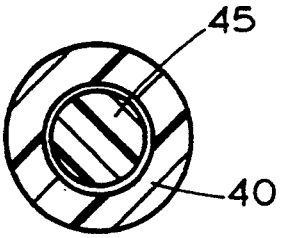

ARTWORK MOUNTING PEG

BACKGROUND OF THE INVENTION

The present invention relates generally to devices for mounting artwork to walls and the like and more particularly, to devices for mounting planar artwork such as mirrors or etched glass some distance off of a wall.

BACKGROUND ART

A variety of hangers and clips have been devised for attaching or mounting artwork such as pictures, mirrors and the like to walls. U.S. Pat. No. 721,579 discloses a wire bent to form two U-shaped loops with pinpoint bars adjacent each of the loops. The pinpoints are inserted into a wall of a showcase and artwork is then set into the U-shaped grooves. U.S. Pat. No. 3,347,504 discloses a clip having a longer flat leg attached to a shorter leg which is bent outwardly and then backwardly to form a channel into which a mirror is placed. Apertures in the longer flat leg are used to attach the clip, and therefore the mirror, to a wall by use of screws. U.S. Pat. No. 4,394,000 discloses mirror clips having a back plate with an elongated slot which receives a mounting screw. Attached to the back plate is a flange and lip adapted to receive a mirror. Guide shoes on the back plate space the mirror off of the back plate so as not to interfere with the head of the screw.

Each of the above devices is designed to mount artwork essentially flush against a wall. U.S. Pat. No. 4,497,125 discloses support blocks, which are attached to a wall by contact adhesive, for mounting artwork a short distance off of a wall. Grooves or channels have been cut into the blocks in order to receive the panels of artwork. Because the grooves are spaced away from the side of the block having the contact adhesive, the panels of artwork will be spaced off the wall.

SUMMARY OF THE INVENTION

In accordance with one embodiment of the present invention, an artwork mounting peg has a spacer with a length greater than about ¼ inch (0.64 cm) and a groove having two sides and a bottom where the sides intersect the bottom at approximately right angles. A cap is connected to the spacer by a neck where the neck has a generally circular cross-section and defines the bottom of the groove. The mounting peg is also provided with means for attaching the peg to a wall.

The spacer of the artwork mounting peg may be a cylinder having a diameter, and the cap may be a cylinder having a diameter substantially equal to the diameter of the spacer.

The means for attaching the peg to the wall may be a screw connected to the spacer and the screw may be a double-sided screw.

The spacer may have an inner cylinder connected to the neck and an outer tube slidable with respect to the inner cylinder where the attaching means is connected to the inner cylinder.

The spacer may have a recess and the neck may have a plug at one of its ends where the plug fits snugly into the recess to connect the cap to the spacer. The recess and the plug may be threaded.

The spacer, the neck and the cap of the artwork mounting peg may be a unitary structure.

Another embodiment of the artwork mounting peg may have a hollow spacer, a cap and elongated neck attached to the cap where the neck is sized and configured to slide within the hollow spacer. Means are provided for attaching the neck to a wall. The elongated neck may be a cylinder and the hollow spacer may have a cylindrical interior surface. The attaching means may be a screw.

BRIEF DESCRIPTION OF THE DRAWINGS

FIG. 5 is a side elevational view of a piece of artwork mounted to a wall by artwork mounting pegs of the present invention;

FIG. 6 is a top view of an embodiment of the artwork mounting peg of the present invention;

FIG. 7 is a sectional view taken along the plane 7—7 in FIG. 6.

FIG. 8 is a sectional view taken along the plane 8—8 in FIG. 7.

FIG. 9 is a top view of an embodiment of the artwork mounting peg of the present invention;

FIG. 10 is a sectional view taken along the plane 10—10 in FIG. 9;

FIG. 11 is a sectional view taken along the plane 11—11 in FIG. 10.

DESCRIPTION OF THE PREFERRED EMBODIMENTS

Figure 1:
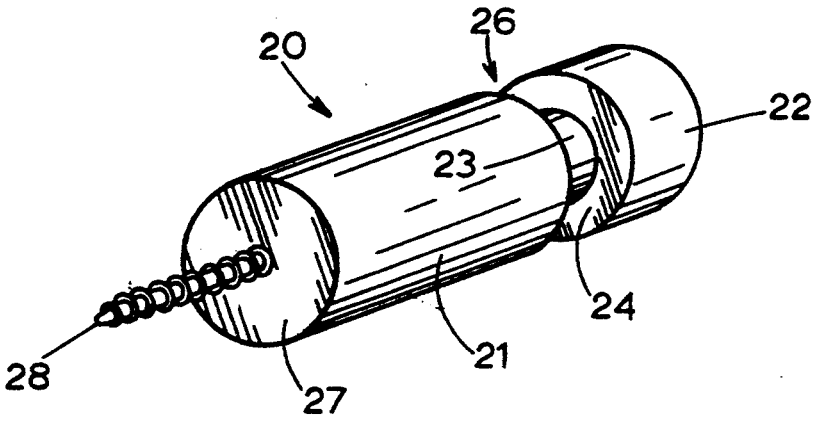
FIG. 1 is a perspective view of an embodiment of the artwork mounting peg of the present invention.
Figure 2:
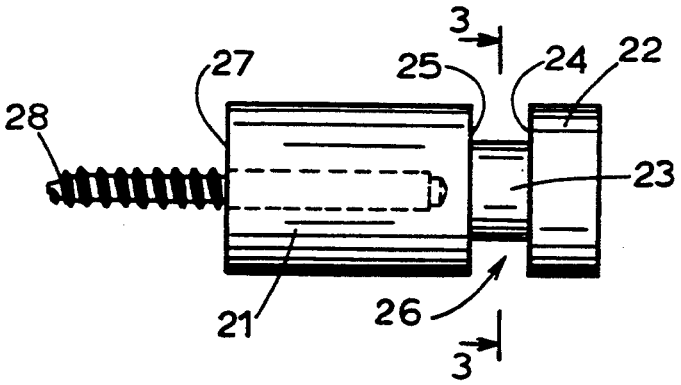
FIG. 2 is a side view of the artwork mounting peg of FIG. 1.
Figure 3:
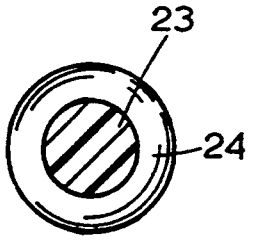
FIG. 3 is a cross-sectional view taken on the plane 3—3 in FIG. 2.

Referring initially to FIGS. 1–3, an artwork mounting peg 20 has a spacer 21 attached to a cap 22 by a neck 23. The spacer 21, the cap 22 and the neck 23 are each cylindrically shaped, with the neck 23 having a diameter smaller than the diameter of the spacer 21 or the diameter of the neck 22. A sidewall 24 on the cap 22 and a sidewall 25 on the spacer 21 together with the neck 23 define a groove 26. The neck 23 defines the bottom of the groove and intersects sidewall 24 and sidewall 25 at approximately right angles. Right angles defining the groove are desirable because artwork will generally have front and back walls which intersect sidewalls at right angles.

Attached to spacer 21 through its endwall 27 is a screw 28 which is used to attach the artwork mounting peg 20 to a wall or other object onto which artwork is mounted. The screw 28 should be aligned with the central axis of the neck 23 so that the bottom of the groove 26 will remain at the same height irrespective of the rotational position of the mounting peg 20. The screw 28 may be attached to the spacer 21 by a variety of methods, including using a double-sided screw, one end of which is rotated into a predrilled hole in the spacer 21. If the artwork mounting peg 20 is molded, the screw can be placed into the mold and the peg formed around it. When the artwork mounting peg 20 is made of a suitable material, the peg and screw can be formed integrally of that one material. Devices other than screws may be used-to attach the mounting peg 20 to a wall. For instance, a nail could be used in place of a screw or an adhesive material could be applied to endwall 27.

Figure 4:
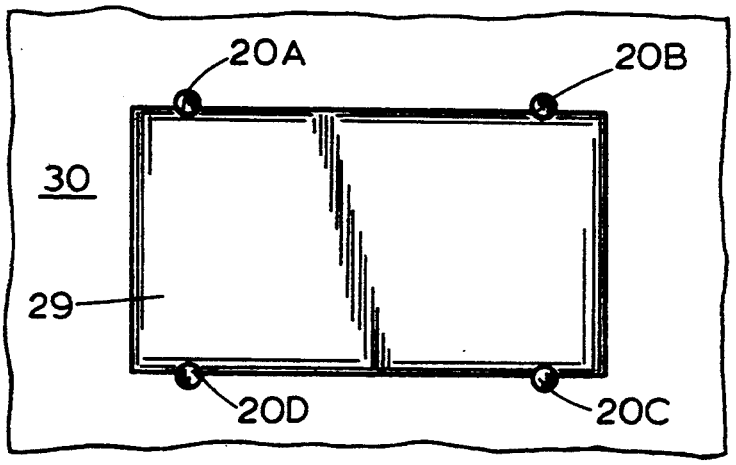
FIG. 4 is a front elevational view of a piece of artwork mounted to a wall by the artwork mounting pegs of the present invention.

FIGS. 4 and 5 depict artwork mounting pegs 20A–D attaching artwork 29 to a wall 30. The artwork 29 depicted is planar and generally rectangular, but circular items such as plates can also be used with the present invention. The screws 28 have been inserted into the wall so that the endwalls 27 are flush against the wall 30. The artwork 29 has been inserted into the grooves 26 to hold the artwork in place. The artwork 29 is spaced off the wall by a distance equal to the length of the spacer 21, which will allow light behind the artwork 29. The artwork mounting pegs 20 are therefore particularly well suited for use with transparent or translucent works of art, although any type of artwork could be mounted using the pegs. In order to allow light behind the artwork 29, the spacer 21 should have a length of at least about ¼ inch (0.64 cm) more preferably, at least about ½ inch (1.27 cm) and most preferably at least about 1 5/16 inches (3.33 cm).

In order to mount the artwork 29 as shown in FIGS. 4 and 5, the two lower pegs 20C and 20D are first inserted into the wall and the artwork is then placed into the grooves 26 of those pegs. Pegs 20A and 20B are then inserted into the wall by placing their grooves 26 over the artwork 29 and rotating the pegs into the wall. Alternatively, all four pegs can be first inserted into the wall 30 and the artwork 29 slid from the side into the grooves until artwork 29 is in its desired position. Four pegs are shown in FIGS. 4 and 5, but fewer may be used or more may be needed depending on the size and weight of the artwork 29 to be mounted.

The artwork mounting pegs can be constructed of a variety of materials and in a variety of sizes depending mainly on the strength of the materials and their appearance. Suitable materials include lucite, polycarbonate and numerous metals such as stainless steel or anodized aluminum. The screw 28 is preferably made out of a metal such as stainless steel. As discussed above, the spacer should be long enough to allow light behind the artwork. A suitable diameter for the cap and the spacer is ⅞ inch (2.22 cm), although different diameters may be used and the cap and spacer need not be the same diameter. Moreover, other shapes for the cap 22 and spacer 21 may be used, but the symmetrical shape of a cylinder is desirable for most applications. A suitable length for the cap is about ⅜ inch (0.95 cm).

The diameter of the neck may be about ½ inch (1.27 cm) and the length of the neck may be about 5/16 inch (0.8 cm). The length of the neck is dependent on the thickness of the artwork which will be placed in the grove of the peg. A length of 5/16 inches (0.8 cm) has been found to work well with artwork which is ¼ inch (0.64 cm) thick, a common size for etched glass and mirrors.

In contrast to the unitary structure of artwork mounting peg 20, a second embodiment is depicted in FIGS. 6–8 having two separate pieces. Artwork mounting peg 31 has a spacer 32 connected to a cap 33 by a neck 34 which has a plug 35 at one end. The spacer 31 has a cylindrical recess 36 into which the plug 35 snugly fits. When the plug 35 is inserted into the recess 36, a right angled groove 37 similar to the groove 26 shown in FIGS. 1–3 is formed. A screw 39 attached to the spacer 32 is used to anchor the mounting peg 31 to the wall.

Artwork mounting peg 31 is screwed into a wall and the plug 35 is partially inserted into the recess 36. The artwork (not depicted) is then placed into the groove 38 and the cap 33 is pushed towards the artwork to further insert the neck 35 into the recess 36. Thus the artwork mounting peg 31 has a recess 38 with an adjustable width and is suitable for a variety of artwork thicknesses. In order for the plug 35 to be retained in the recess 36, the diameter of the plug 35 and diameter of the recess 36 must be nearly identical to insure that the plug 35 is retained in the recess 36 when the artwork is placed on the neck 34. Suitable diameters are ½ inch (1.27 cm) for the plug 35 and 9/16 inch (1.43 cm) for the recess 36. The recess 36 may be about 9/16 inch (1.43 cm) deep.

FIGS. 9–11 depict another embodiment, artwork mounting peg 39, which has a spacer 40, a cap 41 and a neck 42. The spacer 40 is hollow and has a cylindrically shaped interior wall 43. When the neck 42 is placed into the spacer 40, a right angled groove 44 is formed into which artwork may be placed. Since the portion of the neck 42 which is encircled by the spacer 40 is behind the artwork and spaces it off the wall, it can be considered a portion of the spacer. In such a case, the spacer would include an inner cylinder 45 connected to the neck 42 and an outer tube 40 which is slidable with respect to the inner cylinder 45. A screw 46 is attached to the inner cylinder 45 to attach the artwork mounting peg 39 to a wall.

In order to use artwork mounting peg 39, the spacer or outer cylinder 40 is placed over the inner cylinder 45 and then screwed partially into a wall. Artwork is then placed into the groove 44 and the cap 41 is further rotated until the width of the groove 44 is reduced so that the artwork fits snugly into the groove 44.

The dimensions, materials and shapes set forth above in connection with artwork mounting peg 20 shown in FIGS. 1–3 are also suitable for artwork mounting pegs 31 and 38 shown in FIGS. 6–8 and 9–11, respectively.

Numerous modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A combination for displaying artwork on a wall comprising:

a generally planar piece of artwork; and a plurality of artwork mounting pegs, each peg comprising a spacer, a groove having two sides and a bottom, a cap connected to the spacer by a neck and means for attaching the peg to the wall, wherein the neck has a generally circular cross-section and defines the bottom of the groove and the sides of groove are defined by the spacer and the cap, wherein the artwork resides in the grooves of the mounting pegs when the mounting pegs have been attached to the wall and the artwork is displaced from the wall by the spacer.

2. The combination of claim 1 wherein the spacer has a length greater than about ¼ inch (0.64 cm).

3. The artwork mounting peg of claim 1 wherein:

the spacer comprises a cylinder having a diameter; and the cap comprises a cylinder having a diameter substantially equal to the diameter of the spacer.

4. The artwork mounting peg of claim 1 wherein:

the spacer comprises an inner cylinder connected to the neck and an outer tube slidable with respect to the inner cylinder;

and the attaching means is connected to the inner cylinder.

5. The artwork mounting peg of claim 1 wherein:

the spacer has a recess; and the neck has a plug at one of its ends, where the plug fits snugly into the recess to connect the cap to the spacer.

6. The artwork mounting peg of claim 5 wherein the recess and the plug are threaded.

7. The artwork mounting peg of claim 1 wherein the spacer, the neck and the cap are a unitary structure.

8. The artwork mounting peg of claim 1 wherein the attaching means comprises a tapered screw connected to the spacer.

9. The artwork mounting peg of claim 1 wherein the sides of the groove intersect the bottom of the groove at approximately right angels.

* * * * *